US009833070B2

(12) United States Patent
Karu et al.

(10) Patent No.: US 9,833,070 B2
(45) Date of Patent: Dec. 5, 2017

(54) DRAWER FRONT CONNECTION UNIT

(71) Applicant: Grass GMBH, Hoechst (AT)

(72) Inventors: Felix Karu, Altach (AT); Juergen Nachbaur, Hohenems (AT); Patrick Pirker, Fussach (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 15/184,161

(22) Filed: Jun. 16, 2016

(65) Prior Publication Data

US 2016/0316910 A1 Nov. 3, 2016

Related U.S. Application Data

(63) Continuation of application No. PCT/EP2014/078175, filed on Dec. 17, 2014.

(30) Foreign Application Priority Data

Dec. 20, 2013 (DE) ..... 20 2013 011 421 U

(51) Int. Cl.
*A47B 88/00* (2017.01)
*A47B 88/95* (2017.01)

(52) U.S. Cl.
CPC ..... *A47B 88/0051* (2013.01); *A47B 88/95* (2017.01); *A47B 2088/951* (2017.01); *A47B 2210/02* (2013.01)

(58) Field of Classification Search
CPC ..... A47B 88/0055; A47B 88/0422; A47B 88/0433; A47B 88/0437; A47B 88/90;
(Continued)

(56) References Cited

U.S. PATENT DOCUMENTS 3,687,512 A * 8/1972 Alston ..... A47B 88/941 312/348.2
4,042,288 A * 8/1977 Litchfield ..... A47B 88/941 160/381

(Continued)

FOREIGN PATENT DOCUMENTS

AT 407 332 B 2/2001
AT 510 779 A1 6/2012

(Continued)

OTHER PUBLICATIONS

International Preliminary Report on Patentability (PCT/EP2014/078175) dated Jun. 30, 2016.

(Continued)

*Primary Examiner* — Janet M Wilkens
(74) *Attorney, Agent, or Firm* — Burr & Brown, PLLC

(57) ABSTRACT

A drawer front connection unit for a drawer wall element of a drawer. The drawer wall element and a marginal portion of a drawer bottom are insertable to form a drawer side wall adjoining the drawer bottom. The drawer wall element comprises a wall profile part and a bottom-receiving profile part. A support surface is provided on the bottom-receiving profile part, for providing underside support to the drawer bottom. The wall profile part comprises a chamber portion having inner and outer wall sheet portions, which, lying opposite each other, are spaced apart by a width of the drawer wall element and connected by a bent section. The drawer front connection unit fits into the chamber portion of the drawer wall element and extends over a height of the chamber portion. The drawer front connection unit has front-fastening elements.

13 Claims, 2 Drawing Sheets

(58) Field of Classification Search
CPC ... A47B 88/941; A47B 88/951; A47B 88/952; A47B 2088/0074; A47B 2088/901; A47B 2210/09; A47B 2210/0054; A47B 2210/0056; Y10T 403/4642
USPC ..... 312/334.4, 334.5, 334.6, 348.1, 348.2, 312/348.4, 257.1, 263, 265.5; 384/22; 403/DIG. 12, DIG. 13
See application file for complete search history.

(56) References Cited

U.S. PATENT DOCUMENTS

| | | | | | |
|---|---|---|---|---|---|
| 4,832,420 | A * | 5/1989 | Rock | A47B 88/956 | 312/263 |
| 4,850,659 | A * | 7/1989 | Rock | A47B 88/956 | 312/263 |
| 5,540,515 | A * | 7/1996 | Rock | A47B 88/95 | 292/341.17 |
| 5,860,718 | A * | 1/1999 | Brustle | A47B 88/956 | 312/330.1 |
| 5,971,516 | A * | 10/1999 | Huber | A47B 88/941 | 312/265.5 |
| 6,053,593 | A | 4/2000 | Röck | | |
| 6,457,791 | B1 * | 10/2002 | Muterthies | A47B 88/956 | 312/330.1 |
| 8,038,234 | B2 * | 10/2011 | Weber | A47B 88/956 | 312/348.1 |
| 8,727,461 | B2 | 5/2014 | Holzapfel et al. | | |
| 8,801,123 | B2 * | 8/2014 | Kueng | A47B 88/0051 | 312/265.5 |
| 2008/0315740 | A1 * | 12/2008 | Lam | F16B 12/46 | 312/334.1 |
| 2010/0102692 | A1 * | 4/2010 | Hammerle | A47B 88/956 | 312/348.4 |
| 2013/0249370 | A1 | 9/2013 | Kueng | | |
| 2014/0015391 | A1 * | 1/2014 | Feuerstein | A47B 88/18 | 312/334.4 |
| 2014/0049148 | A1 * | 2/2014 | Gasser | A47B 88/04 | 312/334.8 |
| 2014/0225493 | A1 * | 8/2014 | Gasser | A47B 47/00 | 312/265.5 |
| 2014/0312756 | A1 | 10/2014 | Ng | | |
| 2016/0360884 | A1 * | 12/2016 | Karu | A47B 88/0014 | |

FOREIGN PATENT DOCUMENTS

| | | | |
|---|---|---|---|
| AT | 510954 | * | 8/2012 |
| AT | 511 417 | A1 | 11/2012 |
| DE | 100 25 951 | A1 | 11/2001 |
| DE | 10 2011 050 442 | A1 | 11/2012 |
| DE | 20 2014 101 848 | U1 | 7/2014 |
| EP | 1 157 636 | A1 | 11/2001 |
| WO | 2012/068602 | A1 | 5/2012 |
| WO | 2012068595 | * | 5/2012 |
| WO | 2012068599 | * | 5/2012 |

OTHER PUBLICATIONS

International Search Report (With English Translation) and Written Opinion, International Application No. PCT/EP2014/078175, dated Dec. 17, 2014 (10 pages).
German Search Report, German Application No. 20 2013 011 421.5, dated Dec. 2, 2014 (5 pages).

* cited by examiner

DRAWER FRONT CONNECTION UNIT

CROSS REFERENCE TO RELATED APPLICATIONS

This application is a continuation of International Application No. PCT/EP2014/078175 filed Dec. 17, 2014, which designated the United States, and claims the benefit under 35 USC §119(a)-(d) of German Application No. 20 2013 011 421.5 filed Dec. 20, 2013, the entireties of which are incorporated herein by reference.

FIELD OF THE INVENTION

The present invention relates to a drawer front connection unit, a drawer wall element, and a furniture item.

BACKGROUND OF THE INVENTION

For the connection of a drawer, in particular a drawer wall element having a drawer front, drawer front connection units are known in a wide variety of designs within the field of furniture making.

The object of the present invention is to improve a drawer front connection unit for a flexible furniture production.

The present invention is based on a drawer front connection unit for a drawer wall element of a drawer, on which drawer wall element a marginal portion of a drawer bottom is insertable in order to form a drawer side wall adjoining the drawer bottom. The drawer wall element here comprises a wall profile part and a bottom-receiving profile part, wherein on the drawer wall element is provided a support surface, present on the bottom-receiving profile, for providing underside support to a drawer bottom insertable on the drawer wall element. The wall profile part here comprises a chamber portion having an inner wall sheet portion and an outer wall sheet portion, which are spaced apart, one opposite the other, by a width dimension of the drawer wall element and are connected by a bent-over section.

The essence of the present invention lies in the fact that the drawer front connection unit is designed for fitting in the chamber portion of the drawer wall element and extends over a height dimension of the chamber portion, wherein the drawer front connection unit has front-fastening elements for fitting of a drawer front. The drawer front connection unit can advantageously be accommodated in a protected manner within the chamber portion and, at the same time, can be barely or not at all apparent. As a result of the extent over a height dimension of the chamber portion, the drawer front connection unit can be fixed in the chamber portion at fastening positions which offer the advantage of a secure and stable fitting. The drawer front connection unit can here be latched in place, for example by snap-locking, or can be fitted, for example by welding or, for example, by means of screwing or riveting or by a combination of different fastening methods—detachably or non-detachably—in the chamber portion.

The front-fastening elements are preferably configured in a lower region and in an upper region of the drawer front connection unit, whereby, in particular on drawers having a comparatively deep storage space, connecting forces between the drawer front and the drawer wall element can advantageously be distributed, preferably evenly, amongst several connecting points.

If, for different drawer fronts within an appropriate range, respectively different connection methods are necessary, a first of the front-fastening elements can be fitted detachably to the drawer front connection unit in order to be able, where necessary, to exchange the front-fastening element.

For a stable connection of a drawer front to a drawer wall element, it is advantageous if a second of the front-fastening elements is fastened in a permanent, in particular non-detachable manner, to the drawer front connection unit.

A preferred embodiment of the invention lies in the fact that a first of the front-fastening elements can be arranged with the drawer front connection unit in such a way in the chamber region that the first front-fastening element is positionable within the wall profile part such that it bears against a top edge. As a result, the first front-fastening element can be positioned comparatively remote from the, for example, second front-fastening element in order to achieve an advantageously high leverage through the connection to a drawer front.

The front-fastening elements can be connected to each other via an assembly body, which can advantageously be tailored to a shape of the chamber region.

Preferably, at least one of the two front-fastening elements is arranged in such a way on the assembly body that a flat end face of the front-fastening element can be arranged in a plane of an end face of the drawer wall element. In this case, the drawer front connection unit can advantageously reinforce the appropriate end face of the drawer wall element.

Furthermore, it is preferred that one of the front-fastening elements comprises a removable plug element, which is intended to be fastened to the front panel in order to enable a rational production. In particular, as a counterpart thereto, one of the front-fastening elements, preferably the same one, can comprise a socket, which can be fitted to the assembly body.

The socket can be provided with a tension device, with which a tensile force applied to the plugged-in plug element is adjustable for the fastening of the drawer front in order to connect a drawer front with a predefined force to the drawer wall element. In the tension device, a wedge-shaped bolt, which in particular is configured to back-grip the plug element, can be adjustably mounted in order to wedge the plug element under tensile stress in the tension device. To this end, the plug element preferably has a widened plug head.

The assembly body can be configured in the form of a flat, preferably rigid plate, whereby the drawer front connection unit, if need be, can be inserted in chamber portions of different drawer wall elements.

Preferably, to the assembly body can be fitted a filling element, with which the assembly body can be supported against a surface portion on an inner side of the wall profile part, whereby a stability of the drawer wall element can additionally be advantageously increased.

A further aspect of the present invention relates to a drawer wall element for a drawer, on which drawer wall element a marginal portion of a drawer bottom is insertable in order to form a drawer side wall adjoining the drawer bottom, wherein the drawer wall element has a wall profile part and a bottom-receiving profile part, which are respectively designed as separate and mutually coordinated components made of a sheet metal material and are connectable to each other in mutual alignment to form the drawer wall element, so that on the created drawer wall element can be provided a support surface, present on the bottom-receiving profile part, for providing underside support to a drawer bottom insertable on the drawer wall element. It is here essential that to an end-face end of the wall profile part is fitted a drawer front connection unit according to the invention, which is configured according to one or more of the embodiments described above.

The drawer front connection unit can here be arranged on the drawer wall element above the bottom-receiving profile part, wherein the drawer front connection unit and the bottom-receiving profile part can be connected to each other, in particular fixedly.

Furniture items having a drawer front connection unit according to the present invention can be able to be produced comparatively rationally, with increased load bearing capacity.

BRIEF DESCRIPTION OF THE DRAWINGS

The present invention is explained below on the basis of an illustrative embodiment and with the aid of drawings. The reference symbols are used uniformly in all figures in order to denote consistent features.

DETAILED DESCRIPTION OF THE INVENTION

Figure 1:
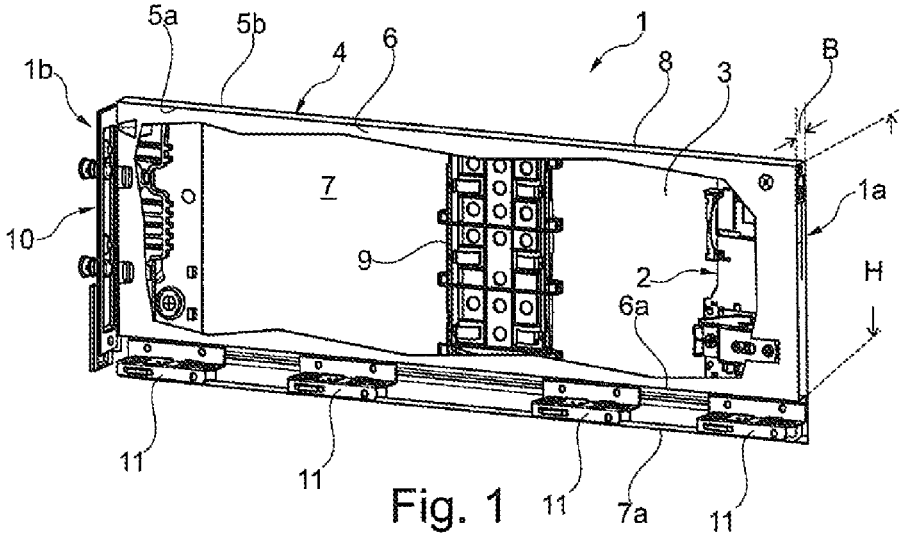
FIG. 1 shows a schematic perspective view of a drawer wall element.

In FIG. 1 is shown a drawer wall element 1 having a drawer front connection unit 2. The drawer front connection unit 2 is fitted in a chamber portion 3 of the drawer wall element 1 to an end-face end 1*a* of the drawer wall element 1.

The drawer wall element 1 comprises a wall profile part 4, which is divided by bending edges 5*a* and 5*b* into an inner wall sheet portion 6, an outer wall sheet portion 7, and a top edge sheet portion 8. The chamber region 3 is defined by a space enclosed by the three sheet portions 6, 7 and 8. In the chamber region 3 is arranged, moreover, a filling element 9, with which the inner wall sheet portion 6 and the outer wall sheet portion 7 are held at a distance apart of a width dimension B. As a result of the filling element 9, the inner wall sheet portion 6 and the outer wall sheet portion 7, at least in the region of the filling element 9, cannot be compressed, so that advantageously the drawer wall element is stabilized in its shape.

On a rear end face 1*b*, the drawer wall element 1 has a rear wall connector 10, with which a rear wall can be fitted to the drawer wall element 1.

On a bottom side of the drawer wall element 1, the outer wall sheet element 7 protrudes downward beyond a bottom edge of the inner wall sheet portion 6. In this case, on a bottom edge 6*a* of the inner wall sheet portion 6, a plurality of bottom-receiving profile parts 11 are fitted to the drawer wall element 1, which are intended to fit a drawer bottom (not shown) on the bottom edge 6*a* of the inner wall sheet part 6.

Figure 2:
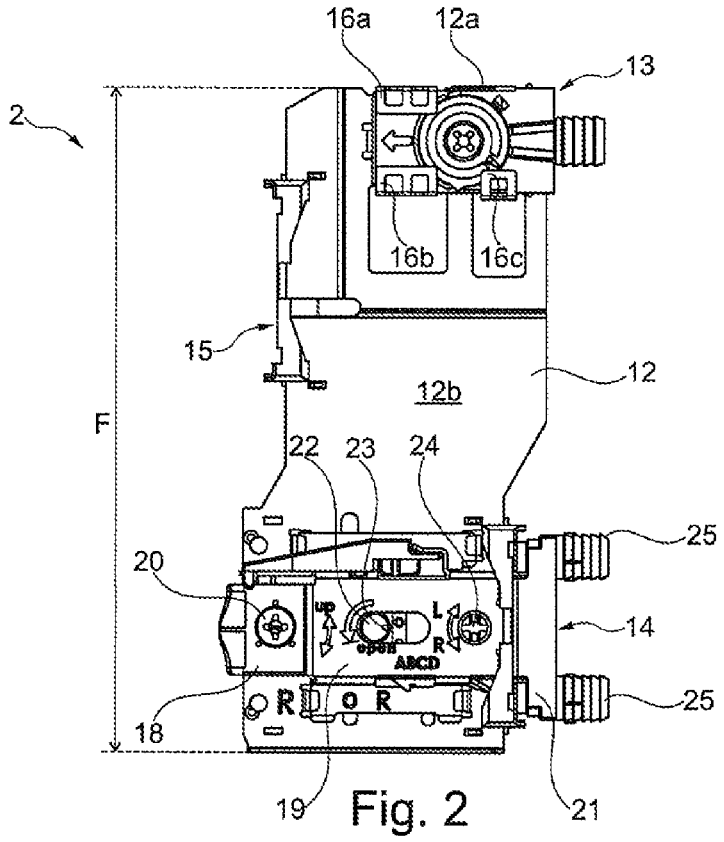
FIG. 2 shows a schematic side view of a drawer front connection unit.

In FIG. 2, the drawer front connection unit 2 is represented with further details. To a mounting plate 12 is fitted in an upper region, for example adjoining a top edge 12*a* of the mounting plate 12, a first front-fastening element 13. A second front-fastening element 14 is fastened in a lower region of the mounting plate 12.

A height F of the mounting plate 12 is tailored to a height dimension H of the chamber portion 3 and tallies, in particular, with the height dimension H. The front-fastening elements 13 and 14 are arranged on the same side face 12*b* at a comparatively large distance apart on the mounting plate 12. As a result, a large part of the height dimension H of the chamber portion 3 can be utilized as the lever length in order to absorb, for example, lateral force effects transversely to the longitudinal axis of the drawer wall element. Such force effects can arise, for example, if a comparatively tall article, for example a drinks bottle, tips over and falls against, for example, the bending edge 5*a*.

To the mounting plate 12 can be fitted a filling element 15, which extends over the width dimension B and bears in the chamber portion 3 against the inner wall sheet portion 6 and against the outer wall sheet portion 7.

Figure 3A:
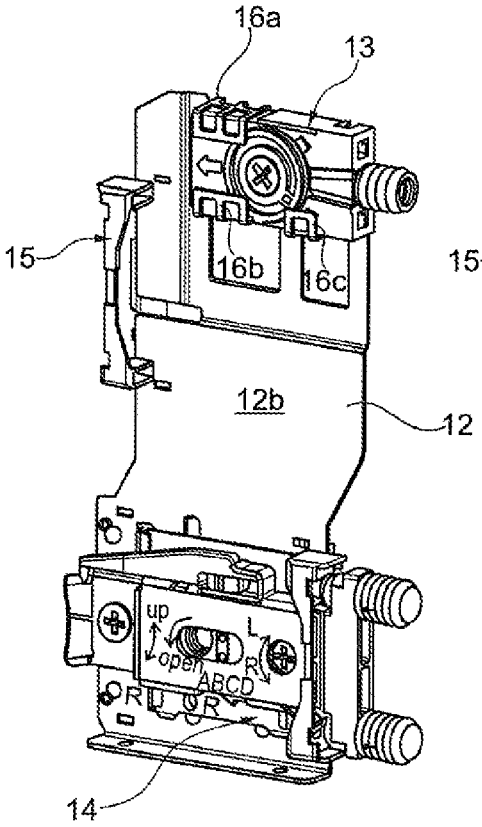
FIG. 3*a* shows a schematic perspective view of a drawer front connection unit.
Figure 3B:
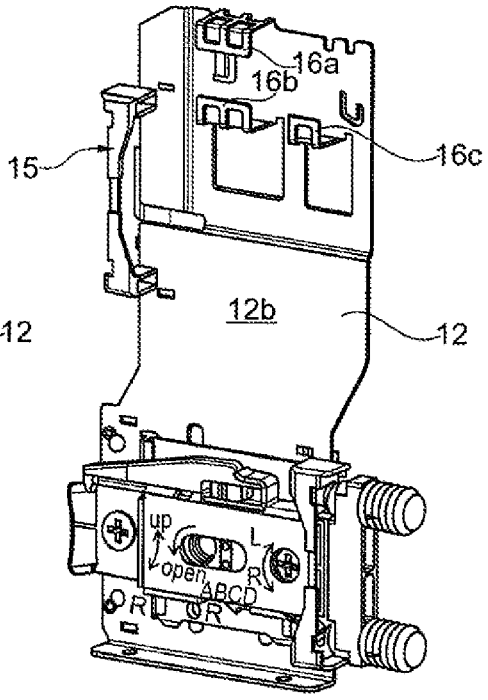
FIG. 3*b* shows a schematic perspective view of a drawer front connection unit.

The front-fastening element 13 is fitted with holding clamps 16*a*, 16*b* and 16*c* to the mounting plate. The holding clamps 16*a*, 16*b* and 16*c* protrude on the side face 12*b* from the mounting plate 12 and are shaped into right-angled U-profiles. Preferably, the holding clamps 16*a*-16*c* are punched out of the mounting plate 12 in such a way that they are connected on one side to the mounting plate 12 and are bent out of the mounting plate. The surface of the front-fastening element 13 and the holding clamps 16*a*-16*c* can be mutually coordinated in such a way that the holding clamps 16*a*-16*c* on the front-fastening element 13, which, in a position shown in FIGS. 2 and 3*a*, is fitted to the mounting plate 12, are latched in place for a positive connection. For another drawer wall element (not shown), there can be provided, instead of the front-fastening element 13, no front-fastening element at all, as shown in FIG. 3*b*. In particular for a warehousing of the drawer front connection unit 2 as a component for furniture production or as a spare part, it is an advantage if the holding clamps 16*a*-16*c* are configured as detachable fitting means for the front-fastening element 13.

The front-fastening element 14 is preferably connected in a fixed and non-detachable manner to the mounting plate 12. On that embodiment of the drawer front connection unit 2 which is shown in FIGS. 1-3*b*, the front-fastening element 14 is different from the front-fastening element 13. The front-fastening element 14 has a main body 18, which is non-detachably fastened to the mounting plate 12. To the main body 18 is fitted a shaft body 19, the position of which is displaceable and adjustable in the vertical direction with a set screw 20. The shaft element 19 is configured to receive a plug element 21 and comprises a latching device (not shown), with which the plug element 21 can be secured in a plugged-in position in the shaft element 19. The main body 18 and the shaft element 19 together form a socket for the plug element 21.

In an opening 22 is arranged an unlocking element 23, which can be moved in order to release the latched-in plug element 21 in the opening 22, for example with a suitable screwdriver (not shown). Furthermore, the shaft element 19 has a set screw 24, with which a horizontal position of the plug element 21 in the shaft element 19 is adjustable. For an assembly, on the plug element 21 are configured two dowel pins 25, which are intended to be hammered into corresponding bores (not shown) on an inner side of a drawer front (not shown). The plug element 21 of the other front-fastening element 14 can thus be fitted to the drawer front (not shown) and afterwards plugged into the shaft element 19 for a latching connection. By means of the adjusting elements 20 and 24, following latching of the plug element 21, a positioning of the drawer wall element 1, and here of a drawer bottom (not shown) inserted on the bottom-receiving profile parts, on a drawer front (not shown) is advantageously possible. For the just described adjustment possibilities, the inner wall sheet part 6 can be breached and open at appropriate places in order that the adjusting elements 20 and 24, for the purpose of the adjustment, are accessible by a user.

Figure 4:
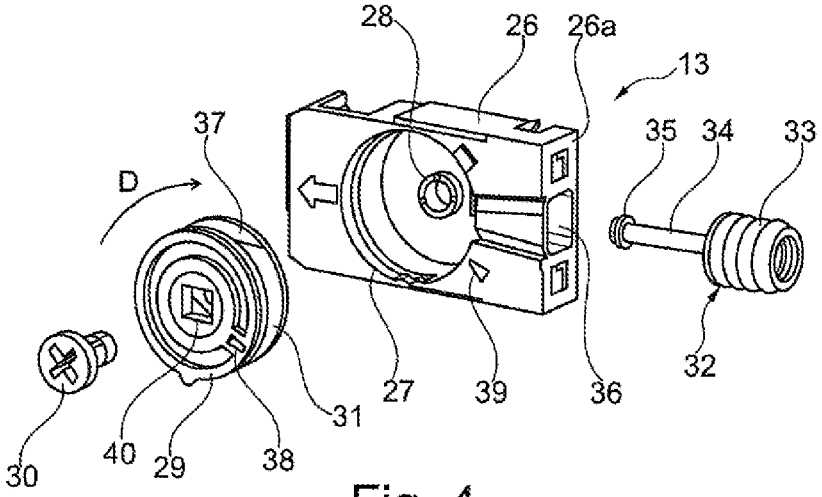
FIG. 4 shows a schematic perspective view of a front-fastening element in exploded representation.

In FIG. 4, the front-fastening element 13 is represented in detail. A cuboid main body 26 has a cylindrical recess 27, in which a hollow-cylindrical bearing journal 28 is arranged such that it protrudes centrally. Into the cylindrical recess 27 is inserted a hollow cylinder body 29, which is mounted rotatably on the bearing journal 28. The cylinder body 29 is fitted to the main body 26 with a holding pin 30, which is rotatably engaged within the bearing journal 28. The holding pin 30 here engages positively in a central square opening 40 on the cylinder body 29. Into the holding pin 30 can be inserted, for example, a Phillips screwdriver (not shown), with which the holding pin 30 and, via this, the cylinder body 29, can be turned in and counter to the direction of the arrow D.

On the main body 26 is configured a funnel-shaped shaft opening 36, which has an inwardly converging, rectangular cross section. Through the shaft opening 36, the cylindrical recess 27, and thus the cylinder body 29, are reachable from an end face 26*a*.

The front-fastening element 13 comprises a plug element 32 having a, for example, cylindrical pin 34, which on a free end has a spherical thickening 35. If a mark 38 on the cylinder body 29 and a mark 39 on the main body 26 are arranged in close proximity to each other, the thickening 35 of the plug element 13 can be introduced through the shaft opening 36 into a slot opening 31 on a cylinder casing wall 37 of the cylinder body 29. Counter to the arrow direction D, the slot opening is of narrowing configuration, wherein the slot opening has in the axial direction of the cylinder body a width which corresponds to a diameter of the cylindrical pin. The cylinder casing wall 37 can here back-grip the plug element 13 at the thickening 35, whereby the plug element 13 can be jointly locked on the main body 26 by rotation of the cylinder body 29 in the arrow direction D.

On that end of the pin 34 which lies opposite the thickening 35 is configured a dowel portion 33, with which the plug element 13, can be hammered into a corresponding bore (not shown) on a drawer front (not shown) for fastening purposes.

REFERENCE SYMBOL LIST

1 drawer wall element
1*a* end face
1*b* end face
2 drawer front connection unit
3 chamber portion
4 wall profile part
5*a* bending edge
5*b* bending edge
6 inner wall sheet portion
6*a* bottom edge
7 outer wall sheet portion
7*a* bottom edge
8 top edge sheet portion
9 filling element
10 rear wall connector
11 bottom-receiving profile part
12 mounting plate
12*a* top edge
12*b* side face
13 front-fastening element
14 front-fastening element
15 filling element
16*a* holding clamp
16*b* holding clamp
16*c* holding clamp
18 main body
19 shaft element
20 set screw
21 plug element
22 opening
23 unlocking element
24 set screw
25 dowel pin
26 main body
26*a* end face
27 recess
28 bearing journal
29 cylinder body
30 holding pin
31 slot opening
32 plug element
33 dowel portion
34 pin
35 thickening
36 shaft opening
37 cylinder casing wall
38 mark
39 mark
40 opening

The invention claimed is:

1. A drawer front connection unit attachable to a drawer wall element of a drawer, on which drawer wall element a marginal portion of a drawer bottom is insertable in order to form a drawer side wall adjoining the drawer bottom, wherein the drawer wall element comprises a wall profile part and a bottom-receiving profile part, wherein on the drawer wall element is provided a support surface, present on the bottom-receiving profile, for providing underside support to a drawer bottom insertable on the drawer wall element, and wherein the wall profile part comprises a chamber portion having an inner wall sheet portion and an outer wall sheet portion, which, lying opposite each other, are spaced apart by a width dimension of the drawer wall element and are connected by a bent-over section, wherein the drawer front connection unit is configured to fit in the chamber portion of the drawer wall element and configured to extend over a height dimension of the chamber portion, and wherein the drawer front connection unit has front-fastening elements for fitting of a drawer front, wherein the front-fastening elements are connected to each other via an assembly body, and wherein one of the front-fastening elements comprises a socket, which can be fitted to the assembly body.

2. The drawer front connection unit as claimed in claim 1, wherein the front-fastening elements are configured in a lower region and in an upper region of the drawer front connection unit.

3. The drawer front connection unit as claimed in claim 1, wherein a first of the front-fastening elements is fitted detachably to the drawer front connection unit.

4. The drawer front connection unit as claimed in claim 3, wherein a second of the front-fastening elements is permanently fastened to the drawer front connection unit.

5. The drawer front connection unit as claimed in claim 1, wherein a first of the front-fastening elements can be arranged with the drawer front connection unit in such a way in the chamber region that the first of the front-fastening elements is positionable within the wall profile part such that it bears against a top edge.

6. The drawer front connection unit as claimed in claim 1, wherein at least one of the front-fastening elements is arranged in such a way on the assembly body that a flat end face of the at least one of the front-fastening elements can be arranged in a plane of an end face of the drawer wall element.

7. The drawer front connection unit as claimed in claim 1, wherein one of the front-fastening elements comprises a removable plug element, which is intended to be fastened to a front panel.

8. The drawer front connection unit as claimed in claim 1, wherein the socket is provided with a tension device, with which a tensile force applied to a plugged-in plug element is adjustable for the fastening of the drawer front.

9. The drawer front connection unit as claimed in claim 1, wherein an assembly body is configured in the form of a flat plate.

10. The drawer front connection unit as claimed in claim 9, wherein the assembly body can be fitted with a filling element, in which the assembly body can be supported against a surface portion on an inner side of the wall profile part.

11. A drawer wall element for a drawer, on which drawer wall element a marginal portion of a drawer bottom is insertable in order to form a drawer side wall adjoining the drawer bottom, wherein the drawer wall element has a wall profile part and a bottom-receiving profile part, which are respectively designed as separate and mutually coordinated components made of a sheet metal material and are connectable to each other in mutual alignment to form the drawer wall element, so that on the created drawer wall element can be provided a support surface, present on the bottom-receiving profile part, for providing underside support to a drawer bottom insertable on the drawer wall element, wherein on an end-face end of the wall profile part is fitted a drawer front connection unit as claimed in claim 1.

12. The drawer wall element as claimed in claim 11, wherein the drawer front connection unit is arranged above the bottom-receiving profile part.

13. A furniture item having a drawer front connection unit as claimed in claim 1.

* * * * *